US008245871B2

(12) United States Patent
Manfredini

(10) Patent No.: US 8,245,871 B2
(45) Date of Patent: Aug. 21, 2012

(54) CONTAINER TO CONTAIN FLUID PRODUCTS

(75) Inventor: Giorgio Manfredini, Cavezzo (IT)

(73) Assignee: CPS Color Equipment Spa Con Unico Socia, San Felice Sul Panaro (IT)

( * ) Notice: Subject to any disclaimer, the term of this patent is extended or adjusted under 35 U.S.C. 154(b) by 672 days.

(21) Appl. No.: 11/568,917

(22) PCT Filed: Apr. 4, 2005

(86) PCT No.: PCT/EP2005/051495

§ 371 (c)(1),
(2), (4) Date: Nov. 10, 2006

(87) PCT Pub. No.: WO2005/107932

PCT Pub. Date: Nov. 17, 2005

(65) Prior Publication Data

US 2008/0087672 A1 Apr. 17, 2008

(30) Foreign Application Priority Data

May 11, 2004 (IT) ..... UD2004A0093

(51) Int. Cl.

| | |
|---|---|
| ***B65B 1/04*** | (2006.01) |
| ***B65B 3/04*** | (2006.01) |
| ***B65B 37/00*** | (2006.01) |
| ***B65C 3/00*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |
| ***B67D 7/70*** | (2010.01) |

(52) U.S. Cl. ..... 220/501; 222/138; 222/139; 222/140; 222/141; 141/238

(58) Field of Classification Search ..... 220/501, 220/503, 555; 222/138, 139, 140, 141; 141/238
See application file for complete search history.

(56) References Cited

U.S. PATENT DOCUMENTS

| | | | | |
|---|---|---|---|---|
| 3,973,758 | A * | 8/1976 | Nyitray et al. | 366/158.1 |
| 4,535,915 | A * | 8/1985 | West | 222/56 |
| 5,285,921 | A * | 2/1994 | Lai | 220/592.25 |
| 5,732,846 | A * | 3/1998 | Helge | 220/521 |
| 5,899,360 | A * | 5/1999 | Mack et al. | 222/83 |
| 6,457,607 | B1 * | 10/2002 | Andrea et al. | 222/63 |

FOREIGN PATENT DOCUMENTS

WO 03/083349 A 10/2003

OTHER PUBLICATIONS

PCT Search Report dated Jul. 27, 2005 of Patent Application No. PCT/EP2005/051495 filed Apr. 4, 2005.

* cited by examiner

*Primary Examiner* — Anthony Stashick
*Assistant Examiner* — Andrew T Kirsch
(74) *Attorney, Agent, or Firm* — Maine Cernota & Rardin

(57) ABSTRACT

A container to contain fluid products, installed in a dispensing machine for fluid products, which is provided with a pair of delivery stations which have respective axes of delivery (X1) arranged at a determinate distance (D1) from each other. The container comprises an outer wall shaped so as to define an inner compartment consisting of two cylindrical zones connected by an intermediate zone. The distance (D2) between the longitudinal axes (X2) of the two cylindrical zones is substantially equal to the determinate distance (D1) between the axes of delivery (X1).

14 Claims, 3 Drawing Sheets

CONTAINER TO CONTAIN FLUID PRODUCTS

FIELD OF THE INVENTION

The present invention concerns a container to contain fluid products, such as for example coloring liquids, bases for paints, varnishes, enamels, inks and suchlike, used in machines for dispensing or distributing said fluid products. To be more exact, the container according to the present invention has a containing capacity substantially double that of traditional containers, while keeping unchanged the overall bulk of the dispensing machine and the lay out of the various operating stations.

BACKGROUND OF THE INVENTION

Machines are known for dispensing or distributing fluid products, such as for example dyes of various shades or color, able to be mixed with each other and/or added to a base substance in order to make a varnish or paint of a determinate color.

Known machines normally comprise a plurality of delivery stations, variable in number, each of which is connected to a relative container containing a determinate dye, through pump means that cause the selective delivery of the fluid product in a suitably chosen quantity, for example with the aid of an electronic processor.

For the preparation of colored varnishes, or the most requested colored paints, the more frequent use of some dyes rather than others is provided, and therefore some containers are finished more quickly than others; this in practice entails the need for more frequent operations to fill or top up the containers, which in some cases, even requires the dispensing machine to be stopped.

A known solution for this disadvantage is obviously to increase the size of each container in order to consequently increase the capacity thereof. This entails an increase in the overall bulk of the dispensing machine on which said container is installed, or at least a reduction in the number of containers provided, and a revision of the lay-out of the various delivery stations.

This known solution therefore not only entails an increase in the costs of design and production, but also a reduction in the quality of the paint or varnish composed, and also a reduction in the possible shades of color that can be obtained.

A purpose of the present invention is therefore to make a container to contain fluid products which will allow to reduce the frequency of top-up interventions, without changing the overall bulk of the dispensing machine in which it is installed, and which will not need a revision of the lay-out of the delivery stations.

The present Applicant has devised, tested and embodied this invention to overcome the shortcomings of the state of the art and to obtain these and other purposes and advantages.

SUMMARY OF THE INVENTION

The present invention is set forth and characterized in claims.

In accordance with the above purpose, a container to contain fluid products according to the present invention is able to be installed in a dispensing machine for said fluid products. The machine is provided with at least a pair of delivery stations from which the fluid products are delivered and which have respective axes of delivery, substantially vertical, arranged at a determinate distance from each other.

According to a characteristic feature of the present invention, the container comprises an outer wall, shaped so as to define an inner compartment substantially consisting of two cylindrical zones connected by an intermediate zone. The two cylindrical zones have their respective longitudinal axes arranged at a distance substantially equal to the determinate distance between the axes of delivery.

In this way, the transverse section of the container according to the invention, with respect to the dispensing machine, has a bulk substantially equivalent to that of two traditional containers with a diameter equal to that of the cylindrical zones, arranged substantially coaxial with the axes of delivery.

The container according to the present invention therefore has a greater capacity than two traditional containers, since its inner compartment consists also of the intermediate zone, which normally cannot contain the fluid product and remains unused.

In this way, it is therefore possible to reduce the frequency of intervention for filling or topping up every individual container.

Moreover, with the container according to the present invention, the bulk size of the dispensing machine in which it is installed remains unchanged, as does the lay-out of the various delivery stations, without therefore entailing any additional cost or any reduction in the number of containers provided.

This advantage thus allows to obtain an optimum quality and a vast range of shades of color of the varnishes or compound paints, while providing one or more containers with a greater capacity.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

These and other characteristics of the present invention will become apparent from the following description of a form of embodiment, given as a non-restrictive example with reference to the attached drawings wherein.

DETAILED DESCRIPTION

Figure 1:
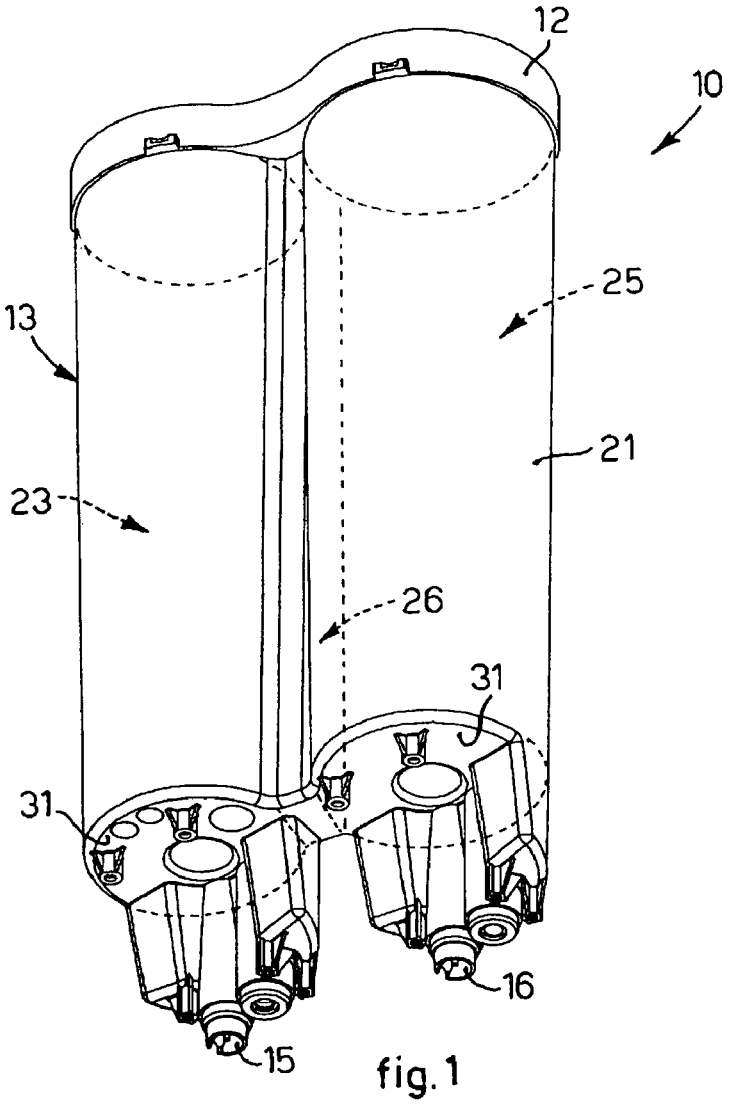
FIG. 1 is a three-dimensional view from below of a container for fluid products according to the present invention.
Figure 3:
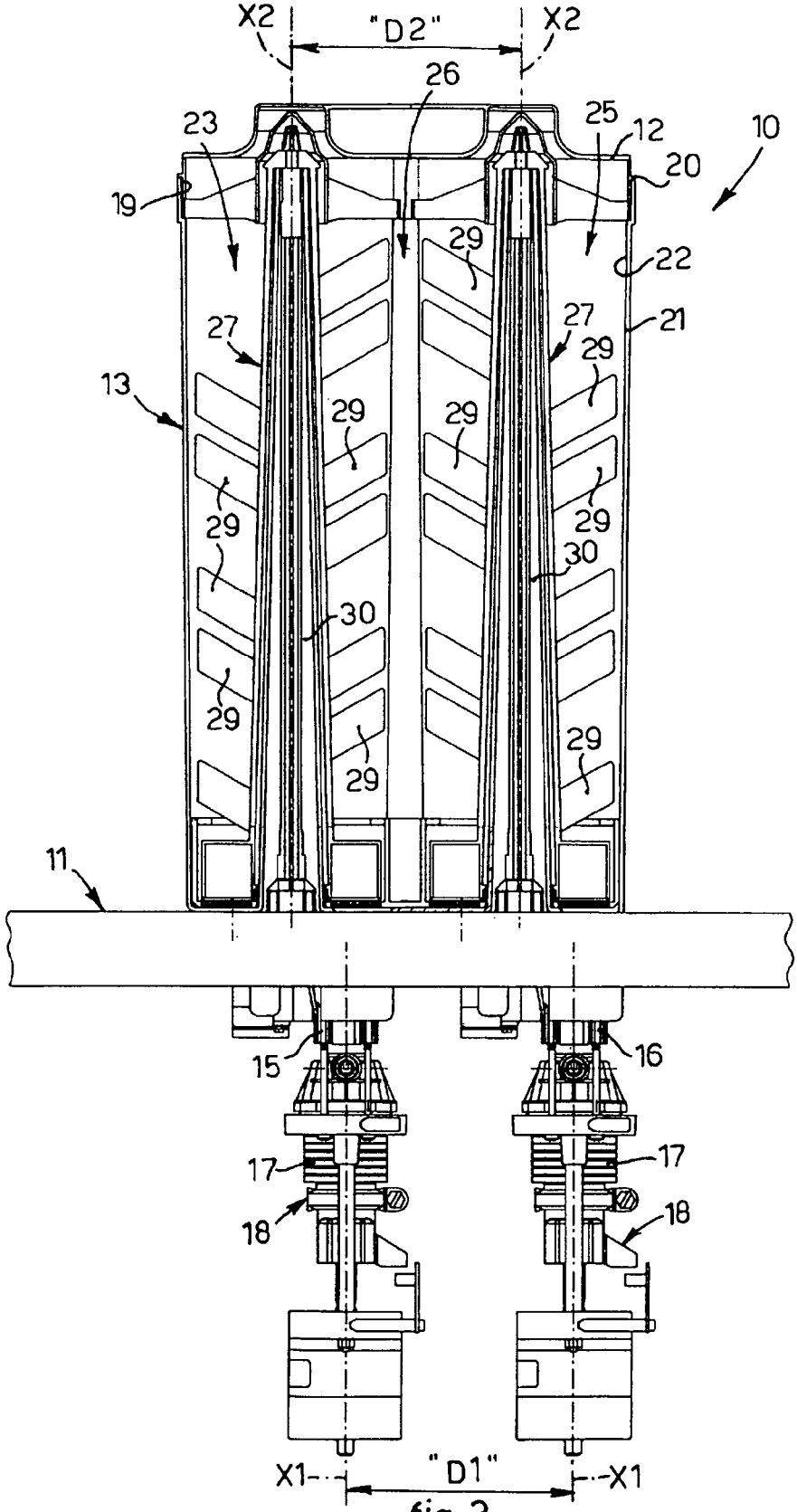
FIG. 3 shows a section along the line from III to III in FIG. 2.
Figure 4:
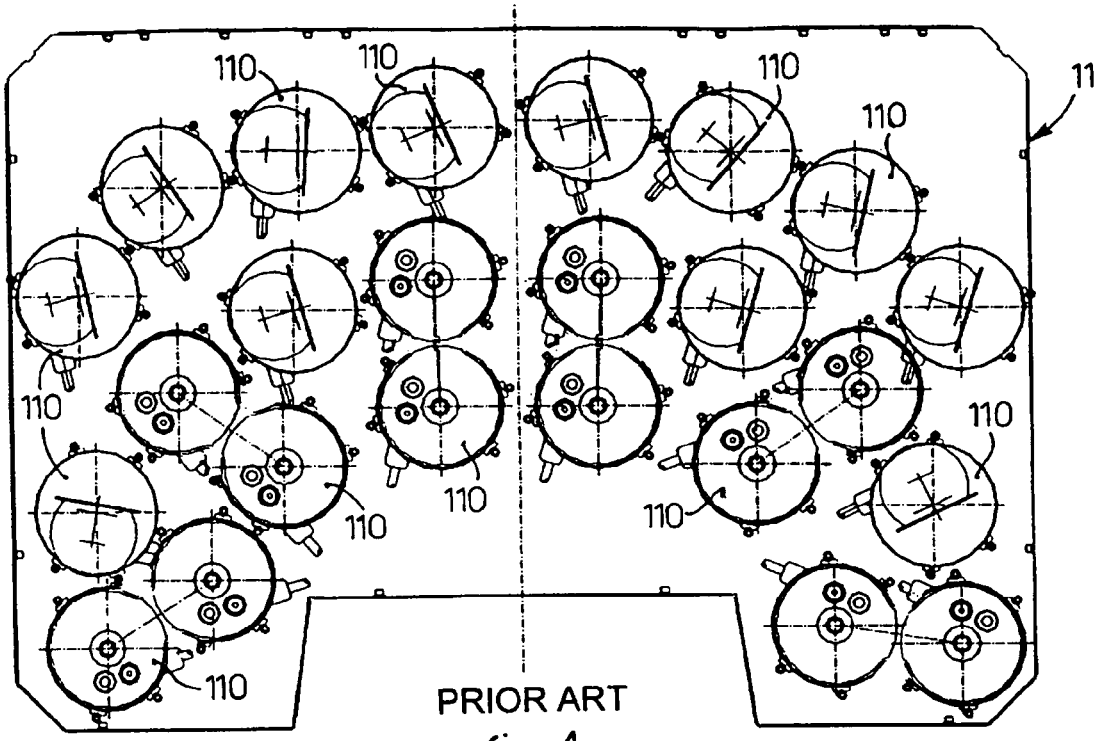
PRIOR ART fig. 4
FIG. 4 shows a lay-out of some traditional containers with respect to a dispensing machine for fluid products.
Figure 5:
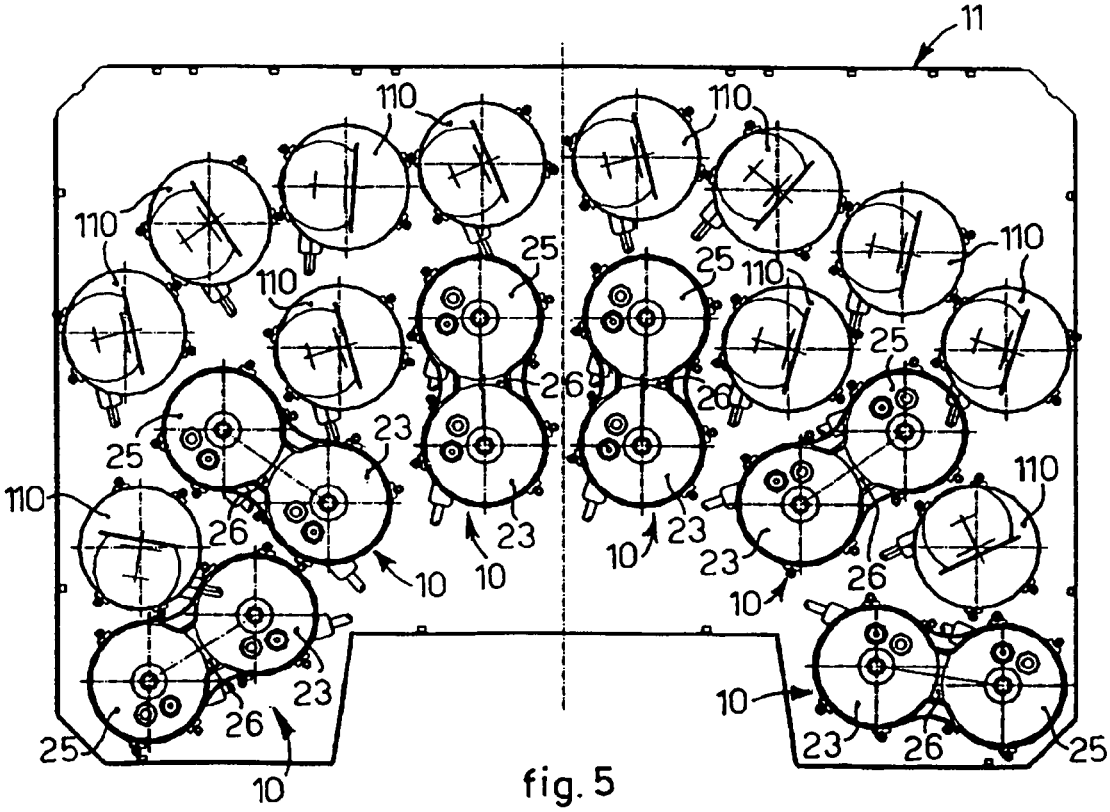
FIG. 5 shows a lay-out for some containers as in FIG. 1 with respect to the machine as in FIG. 4.

With reference to FIG. 1, a container 10 according to the present invention is installed in a dispensing machine 11 for a fluid product, of a known type and shown only partly in FIGS. 3, 4 and 5. The dispensing machine 11 comprises (FIG. 3) a plurality of pairs of fixed delivery stations 18, each having a substantially vertical axis of delivery "X1".

The axes of delivery "X1" of each pair of delivery stations 18 are positioned at a determinate distance "D1" with respect to each other, according to a pre-defined lay-out.

In one form of embodiment, a suction pump 17, for example of the bellows type, is associated with each fixed delivery station 18, and is connected axially to the container 10 along the axis of delivery "X1".

In this embodiment, the use of two suction pumps 17 substantially allows to double the rate of delivery, making the dispensing machine 11 more productive.

Figure 2:
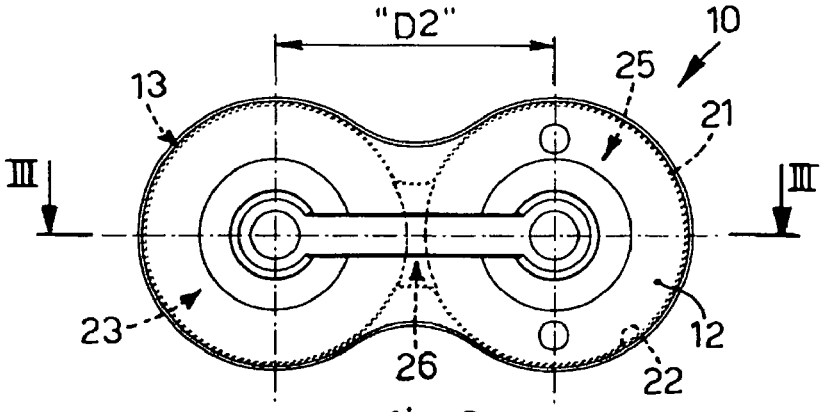
FIG. 2 is a plane view of the container in FIG. 1.

The container 10 according to the invention (FIGS. 1, 2 and 3) comprises, from the top to the bottom, a lid 12, a tank 13, and two outlet pipes 15 and 16, able to be connected coaxially with the respective suction pumps 17.

In the following description, simply as a non-restrictive example, the fluid product is indicated as a dye, but it is clear that the fluid product can be any other coloring liquid, such as for example a base for paint, an enamel, an ink or suchlike.

The lid 12 is shaped in a manner mating with the transverse section of the tank 13, and its only purpose is to selectively close the latter, in order to prevent the impurities and dust present in the air from depositing on the skin of the dye inside the tank 13.

In this case, the lid 12 is advantageously closed on the tank 13 in a seal-tight manner, in order to prevent the dye contained therein from drying out; the seal is achieved by inserting part of the lid 12 inside the tank 13. To be more exact, the tank 13 comprises at the upper part, on an outer wall 21, an insertion seating 19, while the lid 12 comprises on the lower part a perimeter abutment rib 20, able to rest on the upper edge of the outer wall 21, thus defining a position of reciprocal closure between the lid 12 and the tank 13 (FIG. 3). Packings, such as O-rings or suchlike (not shown here) are also advantageously provided, able to ensure the air-tight seal of the closure. According to a variant, not shown in the drawings, attachment members may be provided, of the snap-in type, through interference or coupling in shape, or other known type, suitable to ensure the air-tight seal of the lid 12 and the tank 13.

The tank 13 comprises, as we said, an outer wall 21 shaped so as to define an inner compartment 22 to contain the dye, which substantially consists of two cylindrical zones 23 and 25 (FIG. 2) and an intermediate zone 26 which connects the two cylindrical zones 23 and 25 to each other.

Each of the two cylindrical zones 23 or 25 has a size and an internal containing volume that are substantially equivalent to those of a traditional container, indicated in its entirety by the reference number 110 in FIGS. 4 and 5. The distance "D2" between the longitudinal axes "X2" of the two cylindrical zones 25 or 23 is equal to the distance "D1" between the two axes of delivery "X1" of a pair of delivery stations 18.

In this way it is possible to install the container 10 according to the invention on the dispensing machine 11 without varying the normal lay-out of the delivery stations.

Moreover, inside every cylindrical zone 23, 25 a stirrer device 27 is axially provided, which comprises a plurality of radial blades 29, mounted on an axially rotating shaft 30. The stirrer device 27 is able to keep the dye contained in the tank 13 in constant movement, so as to prevent the homogeneity and stability of the dye from deteriorating.

The intermediate zone 26, as we said, is able to connect the two cylindrical zones 23 and 25 to each other, and is shaped so as to reduce to a minimum the so-called "dead stirring zone", wherein the action of the stirrer devices 27 has a limited effect.

The inner compartment 22 of the tank 13 thus formed has a greater capacity of the intermediate zone 26 compared with two inner compartments of two traditional containers 110, therefore the frequency at which it has to be filled or topped up is reduced.

The two outlet pipes 15 and 16 are mounted on a bottom wall 31 of the tank 13, respectively in correspondence with the two cylindrical zones 23 and 25, in order to allow the dye to exit from the inner compartment 22. In this case, the two outlet pipes 15 and 16 are mis-aligned with respect to the longitudinal axes "X2" of the relative cylindrical zones 23 and 25, to allow the axial housing of the respective stirrer devices 27 inside the tank 13.

According to a variant, not shown in the drawings, the two outlet pipes 15 and 16 can be arranged coaxial with the respective cylindrical zones 23 and 25. In this case the stirrer devices 27 are mis-aligned with respect to the relative axis X2. Each of said outlet pipes 15 and 16 is provided at its lower end with a sealing valve, of a known type and not shown in the drawings, able to keep the passage normally closed for the dye. The sealing valve is automatically opened at the moment of the axial connection along the axis of delivery "X1" with the relative suction pump 17.

FIG. 4 shows a lay-out of the traditional containers 110 in the dispensing machine 11, while FIG. 5 shows the same dispensing machine 11 on which some containers 10 according to the present invention are installed. If we compare FIG. 4 and FIG. 5, we see that the installation of the containers 10 according to the invention does not entail any increase in the overall bulk of the dispensing machine 11, nor any revision of the initial lay-out.

It is clear, however, that modifications and/or additions may be made to the container 10 as described heretofore, without departing from the field and scope of the present invention. For example, according to a variant, the container 10 can be associated with a single suction pump 17, or with two pumps in order to increase productivity, without worsening the resolution and precision of the dye prepared.

It also comes within the field of the present invention to provide that every suction pump 17 can be associated directly with the container 10, and then connected with the respective delivery station 18.

It is also clear that, although the present invention has been described with reference to specific examples, a person of skill in the art shall certainly be able to achieve other equivalent forms of container to contain fluid products, having the characteristics as set forth in the claims and hence all coming within the field of protection thereof.

The invention claimed is:

1. A system for dispensing liquids, said system comprising:

a container;

a dispensing machine, said container being installed within said machine;

said machine comprising first and second delivery stations disposed such that a delivery axis of said first delivery station and a delivery axis of said second delivery station are at a pre-determined distance from each other;

said container having first and second substantially cylindrical zones, said first substantially cylindrical zone is substantially coaxial with said delivery axis of said first delivery station, and said second substantially cylindrical zone is substantially coaxial with said delivery axis of said second delivery station; and an intermediate zone of said container, disposed between and open to said first and second cylindrical zones, said first and second cylindrical zones and said intermediate zone being coupled to said first and second cylindrical zones so as to form a unitary fluid storage chamber of greater volume than a combined volume of said first and second substantially cylindrical chambers.

2. The system as in claim 1, wherein the diameter of each of said two cylindrical zones is equal to the diameter of a traditional container.

3. The system as in claim 1 further comprising a lid shaped so as to mate with a transverse section of an outer wall, and able to be selectively arranged to close an inner compartment in order to prevent access from the outside.

4. The system as in claim 1, wherein an inner compartment is defined at the lower part by a bottom wall connected to a lower edge of said outer wall.

5. The system as in claim 4, further comprising two outlet pipes mounted on said bottom wall in correspondence with the respective cylindrical zones, and able to be axially connected along said axis of delivery to said delivery stations.

6. The system as in claim 5, wherein said outlet pipes are arranged mis-aligned with respect to said longitudinal axes of said cylindrical zones.

7. The system as in claim 5, wherein said outlet pipes are arranged coaxial with respect to said longitudinal axes of said cylindrical zones.

8. The system as in claim 1, wherein inside each of said cylindrical zones a stirrer device is axially provided, able to keep a fluid product arranged in an inner compartment in constant movement.

9. The system as in claim 8, wherein said stirrer device comprises a plurality of radial blades, mounted on an axially rotating shaft.

10. The system as in claim 9, wherein said intermediate zone is shaped so as to limit the reduction of the effect produced by the stirrer devices on the fluid product contained therein.

11. The system as in claim 5, wherein said pair of delivery stations comprises at least a pump, and wherein at least one of said two outlet pipes is able to be selectively connected to said pump.

12. The system as in claim 5, wherein a pump is associated with each of said delivery stations, and wherein both said outlet pipes are able to be connected to corresponding pumps.

13. The system as in claim 5, wherein a pump is associated with each of said delivery stations, and wherein a pump able to be connected to one of said delivery stations is associated with at least one of said pipes.

14. The system as in claim 5, wherein a pump is associated with each of said delivery stations, and wherein a pump able to be connected to one of said delivery stations is associated with both said pipes.

* * * * *